US005582153A

United States Patent [19]

Dutt et al.

[11] Patent Number: 5,582,153

[45] Date of Patent: Dec. 10, 1996

[54] FUEL INJECTION PUMP FOR AN INTERNAL COMBUSTION ENGINE

[75] Inventors: Andreas Dutt, Stuttgart; Burkhard Veldten, Leonberg; Néstor Rodriguez-Amaya; Walter Fuchs, both of Stuttgart, all of Germany

[73] Assignee: Robert Bosch GmbH, Stuttgart, Germany

[21] Appl. No.: 454,357

[22] Filed: Jun. 16, 1995

[30] Foreign Application Priority Data

Nov. 24, 1993 [DE] Germany ..... 43 399 48.7

[51] Int. Cl.[6] ..... F02M 37/04

[52] U.S. Cl. ..... 123/450; 123/506; 251/129.16

[58] Field of Search ..... 123/450, 506, 123/458; 417/462; 251/129.16

[56] References Cited

U.S. PATENT DOCUMENTS

| | | | |
|---|---|---|---|
| 4,604,980 | 8/1986 | Leblanc | 123/450 |
| 5,125,807 | 6/1992 | Kohler | 251/129.16 |
| 5,215,060 | 2/1993 | Kaopfer | 123/450 |
| 5,228,844 | 7/1993 | Klopfer | 123/506 |
| 5,265,576 | 11/1993 | McMahon | 123/458 |
| 5,318,001 | 6/1994 | Djordjevic | 123/450 |
| 5,345,916 | 9/1994 | Amann | 123/450 |
| 5,425,341 | 6/1995 | Connolly | 123/450 |
| 5,503,364 | 4/1996 | Enomoto | 251/129.16 |

FOREIGN PATENT DOCUMENTS

| | | | |
|---|---|---|---|
| 2276264 | 5/1988 | Japan | 123/458 |

*Primary Examiner*—Carl S. Miller

*Attorney, Agent, or Firm*—Edwin E. Greigg; Ronald E. Greigg

[57] ABSTRACT

In a fuel injection pump of the distributor type, a solenoid valve is provided in the distributor and the valve member of this solenoid valve is supported in an axial bore of the distributor and actuated by a magnet fixed to the housing in order to block the connection between a pump working space of the distributor-type injection pump and a relief space during an intended high-pressure injection phase. Inherent in its construction, a distributor of such a fuel injection pump has a certain axial play in its mounting and this has an effect on the actuating travel of the valve member in the distributor in relation to the fixed electromagnet. In order to avoid changes in the magnetic properties, which can arise due to this axial association, part of the magnetic circuit in the form of a magnet plate is displaceable together with the distributor, with the result that the position of an armature connected firmly to the valve member relative to this part of the magnet core, with which it forms the working air gap, does not change depending on the axial position of the distributor, and the magnetic properties of the solenoid valve are thus maintained irrespective of the axial position of the distributor.

20 Claims, 2 Drawing Sheets

FUEL INJECTION PUMP FOR AN INTERNAL COMBUSTION ENGINE

PRIOR ART

The invention starts from a distributor-type fuel injection pump for an internal combustion engine.

A fuel injection pump of this kind is known from EP-A-0 524 132. The fuel injection pump in that document is a so-called radial piston pump, in which radially extending cylinder bores are provided in the distributor, which is driven in rotation, and pump pistons are arranged displaceably in said bores which are supported via roller tappets on a fixed cam ring which surrounds the distributor circumferentially in the region of the cylinder bores. The rotatingly driven distributor here causes the roller tappets to run on the cam ring and thus brings about a reciprocating motion of the pump pistons, which, at the other end, enclose a pump working space by means of their mutually opposite ends. This pump working space can be relieved to the relief space via the connecting passage and the valve controlled by the electromagnet. In the known embodiment, the valve member of this valve is acted upon in the opening direction by a spring and can be moved in the closing direction by a tappet, the tappet being moved by means of an armature which can be adjusted axially relative to the fixed poles of an electromagnet. For exact dimensioning here, the electromagnet must be positioned precisely relative to the distributor. In the known configuration, the axial position of the distributor is secured by means of a disc which engages in an annular groove. However, this manner of attachment has the disadvantage that the axial fixing of the distributor is provided with a play resulting from the tolerances of the components and an additional play which permits an unhindered rotary motion of the distributor without jamming. Thermal expansions of the individual components relative to one another must also be taken into account. As a result of this play, however, the distance between the distributor or valve seat or valve member in its closed position from the magnet may vary at different operating points. This means, on the other hand, that a working air gap provided at the electromagnet between the armature and the magnet pole varies. This in turn is disadvantageous for the operating force applied by the solenoid valve and for the operating speed and dynamics of the operating behavior of the magnet. These deviations lead to variations in the operating time of the valve which determines the high-pressure injection phase and thus to variations in the quantity of fuel injected and time at which injection begins, deviating from the desired injection quantity at the respective operating point.

ADVANTAGES OF THE INVENTION

The fuel injection pump according to the invention, has the advantage that that part of the core forming the magnetic circuit of the electromagnet which interacts with the armature can be adjusted together with the distributor with the result that, when the armature is adjusted simultaneously with the valve member, the working air gap between the armature and this adjustable core remains constant. The forces developed by the electromagnet to operate the valve and the dynamic operating behavior of this solenoid valve thus also remain the same, irrespective of the dimensioning of the axial play of the distributor. As an advantageous further development, the electromagnet is configured as set forth hereinafter in which that part of the core or magnet pole of the electromagnet which interacts with the armature is coupled directly to the end of the distributor. In a particularly advantageous embodiment, an electromagnet of this kind is designed as a solenoid plunger magnet as set forth herein. A preferred configuration of the electromagnet in conjunction with the valve for controlling the connection between the pump working space and the relief space is a subject-matter of the invention. This results in a very compact construction in which the magnetic coupling of the individual parts of the core to one another is guaranteed and low in leakage losses and the part of the core which together with the armature forms the working air gap is nevertheless mobile. By virtue of the fact that the magnetic coupling of this part of the core to the lateral core takes place at the circumference, the magnetic flux density in the magnetic coupling region is relatively small compared with the high magnetic flux density in the region of the working air gap between the armature, which slides in the axial aperture, and that part of the second yoke which surrounds the central opening. The air gaps between this second yoke and the lateral core and between the outer circumference of the armature and the wall of the aperture in the central core contribute only slightly to a magnetic flux loss and can be allowed for as a quasi-constant parameter in the dimensioning of the electromagnet. The significant point in this configuration is that the technical characteristics of the electromagnet do not change, even if the distributor is displaced.

Additional advantageous configurations of the subject-matter of the invention described above are set forth herein. Accordingly, the second yoke advantageously serves at the same time as an abutment for a distributor stop whose width can be varied by means of different spacer rings of different widths and serves at the same time to fix a stop for the valve member, said stop determining the opening stroke. With the solution according to the invention, it is possible to construct both valves which are of inward-opening design and valves which are of outward-opening design. Outward-opening means that the stream of fuel flowing off can flow off in the direction of the outward opening motion of the valve member. In a valve of similar construction which opens inwards, the fuel which has flowed off flows counter to the outward opening motion of the valve member into the interior of the axial bore and from there to a relief space. This stream of fuel gives rise to different opening dynamics than that in the case of the outward-opening valve. In operation, such valves have the advantage of higher stability since hydraulic impulse forces occurring during the opening process and directed counter to the direction of fuel flow have the effect of assisting opening unlike in the outward-opening valve, thus basically preventing brief closing phases during the opening process and an associated instability in the valve behavior.

BRIEF DESCRIPTION OF THE DRAWINGS

Two exemplary embodiments of the invention are depicted in the drawing and are explained in greater detail in the description which follows.

DESCRIPTION OF THE EXEMPLARY EMBODIMENTS

Figure 1:
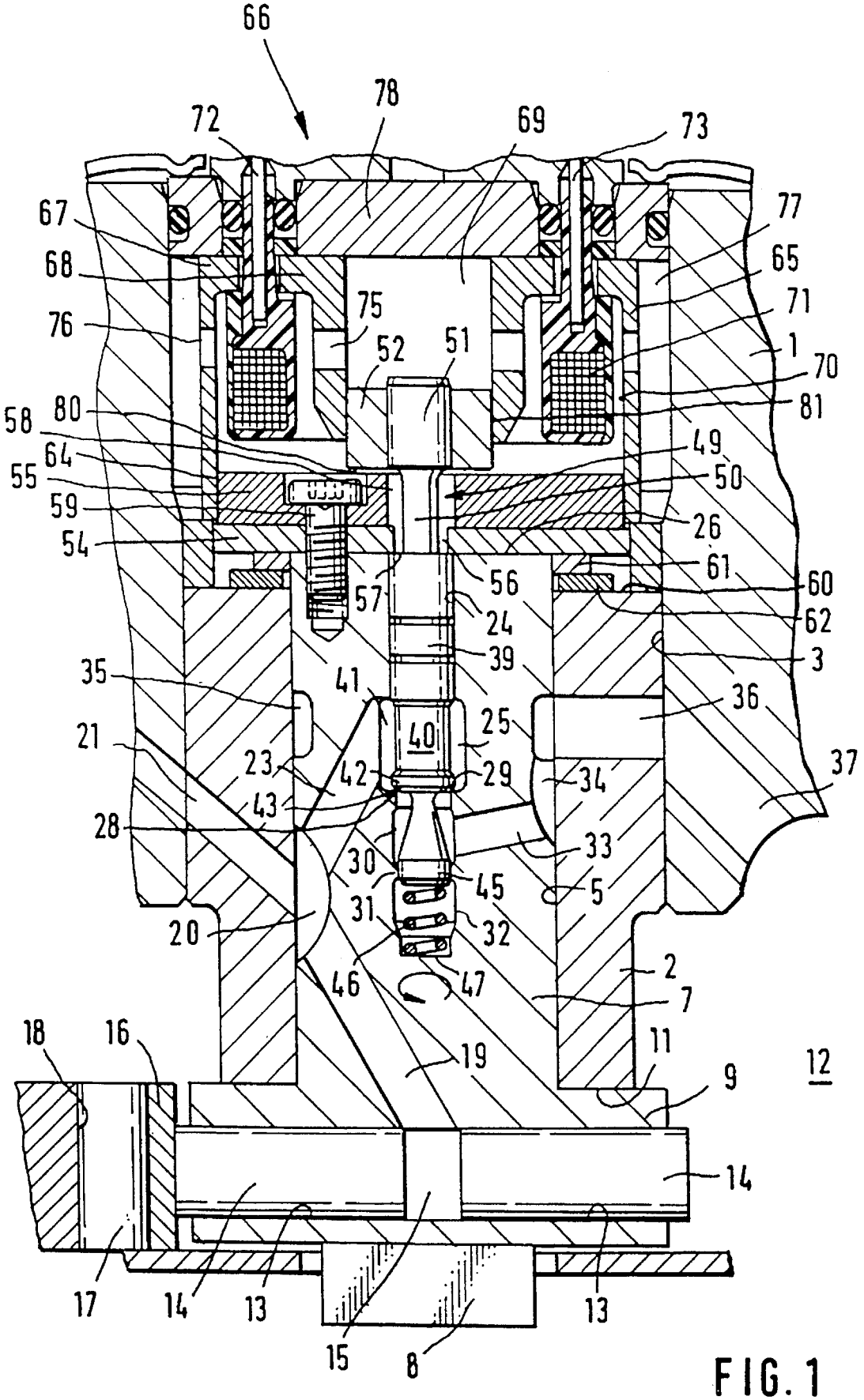
FIG. 1 shows the fuel injection pump according to the invention with an inward-opening valve.

FIG. 1 shows a section through part of a distributor-type injection pump in which the features essential to the invention are implemented. In this arrangement, a bush 2 is inserted into a housing bore 3 in a housing 1 of the fuel injection pump, the bush in turn having on the inside a guide bore 5 in which a distributor 7 is guided. The latter is driven in rotation by way of a coupling part 8 by a drive shaft (not shown specifically) of the distributor-type injection pump and rotates at the same speed as the associated internal combustion engine. At its end projecting on the input side from the bush, the distributor has a collar 9 which runs up against the end 11 of a part of the bush 2 which projects into an inlet space 12. Within the collar there are cylinder bores 13 which extend radially relative to the axis of the distributor and in each of which is guided a pump piston 14, the pump pistons enclosing between their inner ends a pump working space 15. Their outer ends engage on roller tappets 16, the rollers 17 roll on a cam track 18 of a cam ring which surrounds the distributor circumferentially in the plane of the pump pistons 14. The drawing shows the roller tappets and the cam track in each case only in part.

The pump working space 15 is connected via a delivery passage 19 extending inside the distributor to a distributor groove 20 at the circumference of the distributor, the said distributor groove being connectable to injection conduits 21 leading off in the radial plane in which the distributor groove 20 lies from the guide bore 5 and initially in the form of holes, each of said conduits leading to a fuel injection valve (not shown specifically here).

Leading off from the distributor groove 20 in the interior of the distributor there is furthermore a connecting passage 23 which opens into a coaxial blind hole 24 of stepped diameter in the region of an internal annular groove 25 introduced into this blind hole. On its side remote from the end 26 on the other side of the distributor, said end projecting from the bush 2, this internal annular groove forms an annular shoulder 28 which bears a valve seat 29 facing towards the annular groove 25. At this valve seat, the axial blind hole makes a transition from a larger diameter to a smaller diameter, in which, following the annular shoulder 28, there is arranged, first of all, a first annular groove 30 and then, with an interruption provided by a land 31, a second annular groove 32. A second part 33 of the connecting passage 23 leads off within the first annular groove and opens at the lateral surface of the distributor into a longitudinal groove 34 which, for its part, opens into an annular groove 35 which leads via a transverse hole 36 in the bush 2 and an onward-leading conduit 37 to a relief space, in the present case the inlet space 12.

A valve member 39 is guided displaceably, with a sealing fit, in the axial bore 24, which, as already mentioned, is configured as a blind hole, said valve member having in the region of the internal annular groove 25 of the axial bore an external annular groove 40 by means of which, together with the internal annular groove 25, it forms an annular space 41. The external annular groove on the valve member also gives rise to an annular shoulder 42, the outside diameter of which projects beyond the annular shoulder 28 of the axial bore and has a sealing surface 43 which faces the valve seat 29. Adjoining this, towards the smaller-diameter part of the axial bore, at the opening in the region of the annular shoulder 28, the diameter of the valve member tapers and then widens conically to give a guide piston 45 which interacts with the land 31. Engaging on the end of the guide piston is a spring 46, which is supported in the bottom 47 of the axial bore and acts on the valve member in such a way that its annular shoulder 42 tends to rise from the valve seat 29.

The valve member 39 projects from the axial bore at the end 26 of the distributor and, at this projecting end 49, has a neck 50 formed by a reduction in diameter which then makes a transition to a head 51 onto which an armature 52 in the form of a sleeve or designed as a perforated disc is press-fitted or firmly connected to the valve member. The armature can also be integral with the valve member.

The outward movement of the valve member 39 out of the axial bore under the action of the spring 46 is limited by a stop disc 54 which is held between the end 26 of the distributor and a magnet disc 55. Both discs, the stop disc and the magnet disc, have an axial opening, the opening 56 in the stop disc 54 being smaller in diameter than the outside diameter of that part of the valve member 39 which is guided in the axial bore and forming a stop for the annular shoulder 57 where the valve member makes a transition to the neck 50. The opening 58 in the magnet disc 55, on the other hand, is larger. The openings 56 and 58 both take the form of a keyhole such that the largest diameter of the valve member can be guided through the hole of the keyhole and then moved with its neck into its end position in relation to the stop disc and the magnet disc. Both discs are screwed onto the end 26 of the distributor by means of common fastening screws 59. It is possible for just a single disc to be provided instead of the magnet disc 55 and the stop disc 54, while still meeting the requirements, which are both magnetic and mechanical.

Washers 61 and 62 are inserted as spacer washers between the stop disc 54 and one end 60 of the adjoining bush 2, these spacer washers allowing the axial motional play of the distributor between its contact with the collar 9 at the end 11 of the bush 2 and its contact with the stop disc 54 to be set by means of the distance rings on the bush 2.

The stop disc and the magnet disc, which project beyond the diameter of the distributor, rotate together with the distributor during the operation of the fuel injection pump. The magnet disc 55 here forms part of a magnetic circuit or magnet core of an electromagnet. For this purpose, the magnet disc 55 is coupled magnetically at its circumferential face, via an air gap 64, to a sleeve-like lateral core 65 of the magnet 66. The circular-cylindrical inner wall of the lateral core overlaps the circular-cylindrical contour of the magnet disc 55, which thus forms a yoke. The sleeve-shaped lateral core 65 in turn merges via a first yoke 67 lying opposite this second yoke, the magnet disc 55, into a sleeve-shaped main core 68, which has an axial, circular-cylindrical aperture 69 into which the armature 52 plunges in a sliding and tight-fitting manner. The magnet coil 71 of the electromagnet is supported in the annular space 70 formed between the sleeve-shaped lateral core and the main core 68 and has connections 72 and 73 which lead through the first yoke 67. The coil is embedded and is situated with a radial clearance between the main core 68 and the lateral core 65. The annular space 70 is connected via at least one transverse passage 75 in the wall of the main core and a transverse passage 76 in the wall of the lateral core both with the aperture 69 and with an annular space 77 which surrounds the lateral core and is connected in a manner not shown specifically here to the relief space 12, the inlet space. The aperture 69 is closed from the side of the first yoke 67 by a closure part 78, with the result that an interior space closed at the other end by the armature 52 is formed in the aperture 69, this interior space being, as already mentioned, connectable to the relief space via the transverse passages 75 and 76 such that the armature can move axially without hindrance in the main core and there is at the same time also a flow of fuel around the magnet coil, the fuel being pumped by the pumping backward and forward motion of the armature during its working strokes.

The magnet core of the electromagnet thus comprises, on the one hand, a fixed magnet core with the main core, of hollow design customary in the case of solenoid-plunger magnets, the first yoke 67 and the lateral yoke 65 and, in the special configuration in accordance with the invention now has a movable part, a second yoke in the form of the magnet disc 55, which interacts with the armature 52. The working air gap 80 is formed between that end of the armature which faces the end of the distributor or front face of the magnet disc 55 and the magnet disc, while the armature is coupled magnetically to the main core at the circumference via a coupling air gap 81.

During the operation of the internal combustion engine, the pump working space 15 is filled with fuel via the delivery passage 19, the connecting passage 23 and, when the valve member 39 is open, via the second part 33 of the connecting passage and the transverse hole or conduit 37 as the pump pistons 14 are moved outward during the suction stroke, following the cam track 18, with the result that the volume of the pump working space 15 increases and fuel is taken up. During the subsequent inward stroke of the pump pistons 14 brought about by the cams of the cam track 18, the volume of the pump working space decreases and the fuel is pumped back the same way as long as the valve member is raised from the valve seat 29. At the beginning of the high-pressure production, the valve member is moved into the closed position by the electromagnet and it thus rests by its sealing surface 43 on the seat 29. In the course of the further pump-piston delivery stroke, fuel is then pumped under high pressure, via the delivery passage 19 and the distributor groove 20 into a respective injection line 21 controlled by the latter, for injection. The high-pressure injection is ended when the solenoid valve rises from its valve seat again and the pump working space is relieved to the relief side. The movement into the closed position is brought about by excitation of the magnet such that the armature 52 is moved towards the magnet disc 55 until the valve member is in the closed position. The opening movement of the valve member when the magnet is not excited is brought about by the spring 46 until its annular shoulder 57 comes to rest on the stop disc 54.

The configuration in accordance with the invention has the advantage that the distributor can be secured axially with play and this is in fact necessary or unavoidable for technical reasons. However, this play does not give rise to any change in the working air gap 80. The magnet disc is always at a fixed distance from the seat 29 in the distributor and the armature 52 is likewise at a fixed distance from the seat 29 in the distributor when the valve member is resting on the seat 29. The working air gap 80 thus remains constant irrespective of the position of the distributor. Given a slight displacement of the distributor, the armature plate 55, which rotates together with the distributor, moves within the inside diameter of the sleeve-shaped lateral core 65 but remains magnetically coupled there to the lateral core via the air gap 64. The displacement does not here result in any changes which would influence the movement of the armature. A change in the depth of entry of the armature into the main core 68 due to the displacement of the distributor does not have any effect on the actuating force of the magnet and its dynamics either. The leakage losses at the circumference of the magnet disc 55, which arise due to the air gap 64 at that point, are comparatively small since the magnetic flux is distributed over a large passage area which is very large in relation to the area in the region of the working air gap, with the result that the magnetic flux density there is low. However, these magnetic losses can be allowed for at little expense when designing the magnet. The essential point is that, during operation, a constant actuating force of the magnet is maintained and no variations in the actuating dynamics occur. It is also advantageous that the armature is fixed firmly to the valve member, with the result that there is no mechanical wear here caused by impacting components, as is the case with other customary designs for the actuation of a valve member. The integral construction of the armature and valve member also provides better control as regards the dynamics of motion than a two-piece embodiment in which the valve member is actuated by a tappet resting on the valve member. The setting of the residual air gap at the working gap 18 can be achieved in a simple manner since the relative arrangement of the press-fitted armature component 52 and the magnet disc with its flat surface is a simple matter.

Figure 2:
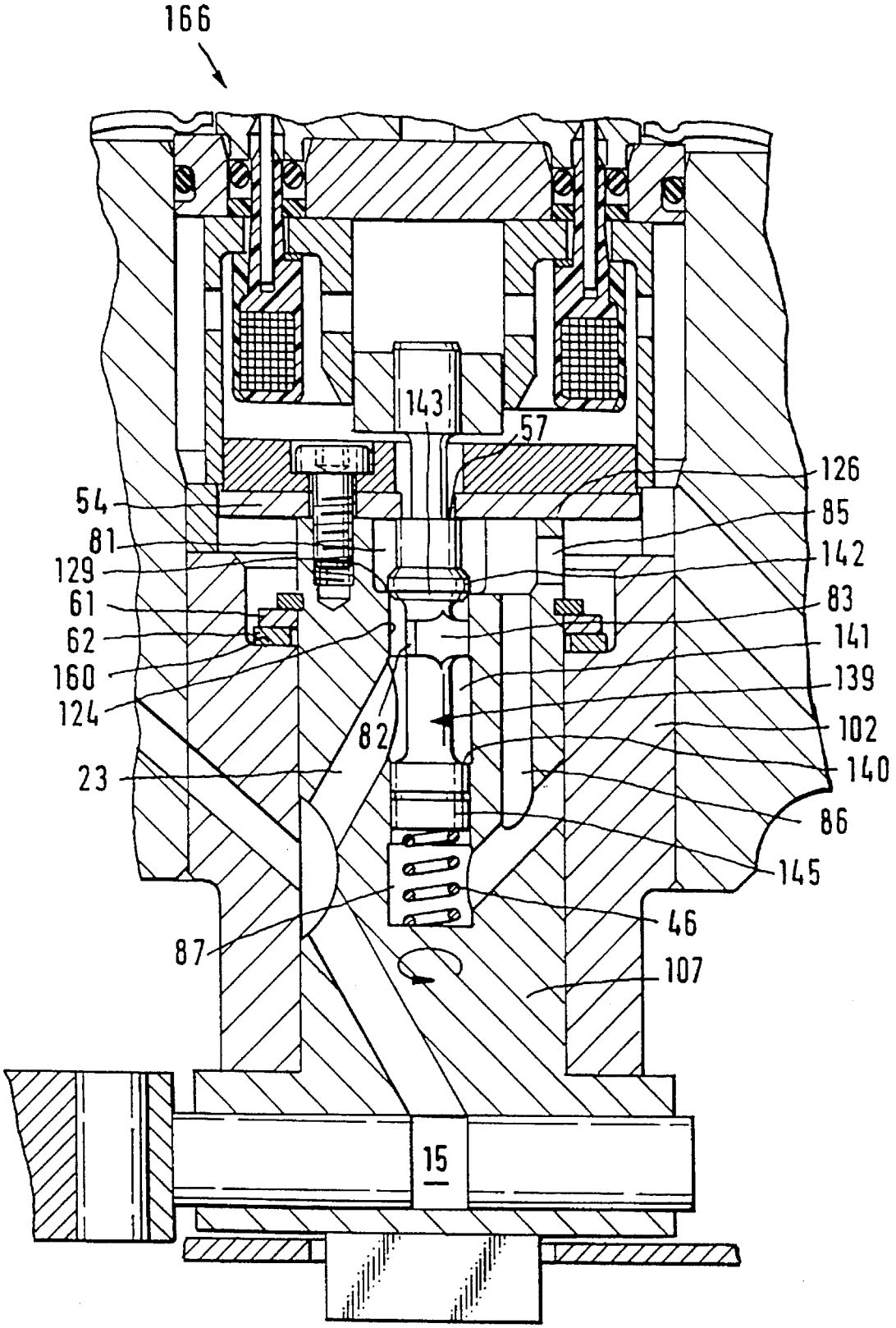
FIG. 2 shows the fuel injection pump according to the invention with an outward-opening valve.

As a modification to the exemplary embodiment in FIG. 1, the valve member in the exemplary embodiment in FIG. 2 is of somewhat different design and embodied as an outward-opening valve. The only differences in this case are the routing of the connecting passage and the design of the axial bore which accommodates the valve member. In the exemplary embodiment according to FIG. 2, the axial bore 124 is made with an approximately equal diameter throughout. In the region of the entry of the connecting passage 23, the valve member 139 again has an external annular groove 140 which, together with the blind hole 124, forms an annular space 141. This annular space is bounded on that side of the valve member which is remote from the end 126 of the distributor 107 by a guide piston 145 which is pushed outward in the direction of motion of the valve member by the spring 46 arranged in the remainder of the blind hole in accordance with FIG. 1. The other end of the annular space is now bounded by an annular shoulder 142 on the valve member 139, said annular shoulder being arranged outside the axial bore 124. In the region of this annular shoulder 142, the axial blind hole 124 makes a transition to a recess 81 of widened diameter and, at the transition to this recess 81, has a valve seat 129. This interacts with a sealing surface 143 provided on the annular shoulder 142 such that, when the valve member is moved inward counter to the force of the spring 46, the valve member closes the outlet of the axial bore 124 into the recess 81. In the intermediate region between the annular shoulder 142 and the guide piston 145, the valve member furthermore has guide webs 82 which are supported on the wall of the axial bore 124 and are formed from a collar which is provided with flats 83 to allow the passage of the fuel from the connecting passage 23 to the valve seat 129 or emergence into the recess 81. Adjoining the annular shoulder 142, the valve member 139 again has the annular shoulder 57 by means of which it comes to rest against the stop disc 54 in order to limit its opening stroke. The valve member and the fuel injection pump with the magnet 166 are then of identical design to the exemplary embodiment above.

A connecting passage 85 leads off transversely from the recess 81 to a relief space, and a relief conduit 86 of the space 87 enclosed by the guide piston 145 furthermore also opens into this recess. In principle, the exemplary embodiment in accordance with FIG. 2 operates in the same way as the exemplary embodiment in accordance with FIG. 1 except that different conditions prevail as regards flow and impulses, said conditions bringing advantages in one form or another depending on the application. As an alternative possibility for limiting the axial play, a retaining ring 89, between which and one end 160 of the bush 102 spacer washers 61 and 62 are again inserted, is inserted at the outer circumference of the distributor in this exemplary embodiment in accordance with FIG. 2.

The foregoing relates to preferred exemplary embodiments of the invention, it being understood that other variants and embodiments thereof are possible within the spirit and scope of the invention, the latter being defined by the appended claims.

We claim:

1. A fuel injection pump of the distributor type for supplying a plurality of individual injection valves of an internal combustion engine, comprising a distributor (7) which is driven in rotation and secured at its axial position in a guide bore (5) and has a distributor opening (20) for successively supplying the individual injection valves with fuel delivered pump working space (15) raised to a high pressure and fed to the distributor opening (20) via the distributor, a valve member which is actuated by an electromagnet (66) arranged in a manner fixed relative to a housing (1) of the fuel injection pump as an axial extension of the distributor (7), said valve member can be moved axially in the distributor (7), interacts with an axially aligned valve seat (29) in the distributor (7) and controls a connecting passage (23, 33) between the pump working space (15) and a relief space (12), wherein the valve member is firmly coupled to an armature (52) of the electromagnet (66) and that a part (55) of a core (68, 67, 65, 55) forming a magnetic circuit of the electromagnet (66) which interacts with the armature (52) is axially adjustable together with the axial adjustment of the distributor (7).

2. The fuel injection pump as claimed in claim 1, wherein that part (55) of the core forming the magnetic circuit of the electromagnet which interacts with the armature is coupled to an end (26) of the distributor (7) and is coupled magnetically to remaining core parts of the electromagnet (66) which carry a magnetic flux via an air gap (64) extending transversely to the longitudinal direction of the distributor.

3. The fuel injection pump as claimed in claim 2, wherein the armature (52) is designed as a solenoid plunger.

4. The fuel injection pump as claimed in claim 3, wherein the electromagnet has a central, axially oriented main core (68) which has an axial aperture (69), which is surrounded circumferentially by a magnet coil (71) of the electromagnet and is connected by way of a first yoke (67) to a sleeve-like lateral core (65) which surrounds the magnet coil circumferentially, and the part (55) of the core which interacts with the armature (52) that plunges into the axial aperture (69), said part acting as a second yoke, has a central opening (58) for passage of the valve member to a part forming the solenoid plunger, said part (55) is firmly connected to the end (26) of the distributor (7) and is coupled magnetically at the circumference, via a radially adjoining air gap (64), to the sleeve-shaped lateral core (65).

5. The fuel injection pump as claimed in claim 4, wherein the valve member (39) is assigned a stop (54) on the distributor (7) to limit its opening movement.

6. The fuel injection pump as claimed in claim 4, wherein to secure the axial position of the distributor (7) in the guide bore (5), a stop (11) which is fixed to the housing at an end remote from the end (26) of the distributor and interacts with a corresponding stop on the distributor and interacts with a corresponding stop on the distributor is provided as a first, fixed stop, and a second, adjustable stop is provided, which is formed between the second yoke (55) projecting radially beyond the circumference of the distributor (7) and a housing wall adjoining the end of the distributor with the interposition of at least one spacer washer.

7. The fuel injection pump as claimed in claim 5, wherein the stop for the opening stroke of the valve member (29) on the one hand comprises an annular shoulder (57) on the vale member and on the other hand comprises a stop disc (54) which is held between the second yoke (55) and the end (26) of the distributor (7) and through which the end (49) of the valve member (39) is passed via a central opening (56).

8. The fuel injection pump as claimed In claim 5, wherein the stop for the opening stroke of the valve member (39) on the one hand comprises an annular shoulder (37) on the valve member and on the other hand comprises the second yoke, through which the end (49) of the valve member (39) is passed via a central opening (58).

9. The fuel injection pump as claimed in claim 7, wherein the annular shoulder (57) on the valve member is formed by reduction in the diameter of the valve member (39) in the form of a neck (50), which is passed through the opening (56, 58).

10. The fuel injection pump as claimed in claim 8, wherein the annular shoulder (57) on the valve member is formed by reduction in the diameter of the valve member (39) in the form of a neck (50), which is passed through the opening (56, 58).

11. The fuel injection pump as claimed in claim 4, wherein the armature (52) is designed as a perforated disc (52) which is press-fitted onto the end (49) of the valve member (39).

12. The fuel injection pump as claimed in claim 7, wherein the second yoke (55) has a keyhole-shaped opening (58) as an opening.

13. The fuel injection pump as claimed in claim 7, wherein the stop disc has a keyhole-shaped opening (56) as an opening.

14. The fuel injection pump as claimed in claim 12, wherein the second yoke (55) is screwed onto the end (26) of the distributor (7).

15. The fuel injection pump as claimed in claim 13, wherein the second yoke (55) is screwed onto the end (26) of the distributor (7).

16. The fuel injection pump as claimed in claim 1, wherein the valve seat (129) is arranged at the exit of an axial bore (124) accommodating the valve member (139) from the distributor (107) and the valve member has a collar which forms as annular shoulder (142) and delimits an annular groove (140) in the valve member (139), said annular groove being situated in the region of the axial bore (124) and at least in part forming an annular space (141) into which the connecting passage (19, 23, 33) between the pump working space (15) and the relief space (12) opens, and projecting from the valve member in the region of the annular groove (14) there are guide webs (82) which are supported on a wall of the axial bore (124).

17. The fuel injection pump as claimed in claim 15, wherein the guide webs are formed as plates (83) on a collar.

18. The fuel injection pump as claimed in claim 15, wherein the collar forming the annular shoulder (142) is arranged within a larger-diameter recess (81) which adjoins the axial guide bore (124) and is connected via a connecting passage (85) to a relief space (12).

19. The fuel injection pump as claimed in claim 1, wherein the valve seat (29) is formed on a lateral boundary wall at an end remote from the end (26) of the distributor of an annular recess (25), said recess at least partially forming an annular space (41), in the wall of an axial bore (24) which guides the valve member (39), in which recess the connecting passage (19, 23, 33) between the pump working space (15) and the relief space (12) emerges.

20. The fuel injection pump as claimed in claim 4, wherein the electromagnet is arranged in a space filled with fuel, the magnet coil (71) is arranged with radial clearance between the outer wall of the main core (68) and the inner wall of the lateral core (65), and at least one transverse passage (75) is arranged in the main core which connects the space enclosed by the armature (52) in the aperture (69) of the main core (68) to the space accommodating the magnet coil (71) and bounded axially by the second yoke (55), and at least one transverse passage (76) is provided in the lateral core which connects the space accommodating the magnet coil to a space formed between the lateral core (65) and the housing (1) of the fuel injection pump and filled pressure relieved fuel.

* * * * *

UNITED STATES PATENT AND TRADEMARK OFFICE

CERTIFICATE OF CORRECTION

PATENT NO. : 5,582,153

DATED : December 10, 1996

INVENTOR(S) : Andreas Dutt et al

It is certified that error appears in the above-indentified patent and that said Letters Patent is hereby corrected as shown below: Title page: Please change item [22] to read as follows:

[22] PCT Filed: Nov.22, 1994

Below item [22] please add items:

[86] PCT No.: PCT/DE94/01369

§ 371 Date: Jun.16, 1995

§ 102(e) Date: Jun.16, 1995

[87] PCT Pub. No.: WO95/14857

PCT Pub. Date: Jun.1, 1995

Signed and Sealed this

Tenth Day of June, 1997

Bruce Lehman

*Attest:*

BRUCE LEHMAN

*Attesting Officer*

*Commissioner of Patents and Trademarks*